United States Patent [19]

Dubach

[11] Patent Number: 4,717,033

[45] Date of Patent: Jan. 5, 1988

[54] PLASTIC CLOSURE WITH SAFETY BAND

[75] Inventor: Werner F. Dubach, Hubrain, Switzerland

[73] Assignee: Alfatechnic AG, Switzerland

[21] Appl. No.: 897,318

[22] Filed: Aug. 18, 1986

[30] Foreign Application Priority Data

Aug. 19, 1985 [CH] Switzerland ..... 3563/85

[51] Int. Cl.[4] ..... B65D 41/34

[52] U.S. Cl. ..... 215/245

[58] Field of Search ..... 215/245, 237, 238, 235

[56] References Cited

U.S. PATENT DOCUMENTS

| | | | |
|---|---|---|---|
| 108,506 | 10/1870 | Morganstern | 215/245 |
| 1,613,358 | 1/1927 | Payne | 215/245 |
| 3,986,634 | 10/1976 | Smith et al. | 220/288 |
| 4,487,324 | 12/1984 | Ostrowsky | 215/235 |
| 4,629,081 | 12/1986 | McLaren | 215/237 X |

FOREIGN PATENT DOCUMENTS

| | | | |
|---|---|---|---|
| 2456931 | 8/1976 | Fed. Rep. of Germany . | |
| 2904181 | 8/1980 | Fed. Rep. of Germany . | |
| 576376 | 6/1976 | Switzerland | 215/250 |

*Primary Examiner*—Donald F. Norton

*Attorney, Agent, or Firm*—Thomas W. Speckman; Ann W. Speckman

[57] ABSTRACT

A one-piece closure with a snap-on hinged type closure provided with a safety band. When the safety band is still intact, the closure cannot be opened. Once the safety band has been removed, the closure is movable to a lower position relative to the upper edge of the container neck by rotation about a threaded container neck or by downward axial movement. While the closure is in its upper position and the safety band is intact, a catch engages underneath a projection on the base of the closure and prevents the cap from being opened. When the closure is in its lower position, the upper edge of the container neck releases the catch from behind the projection and the sealing cap can be opened. While the safety band is still intact, interaction of an external ratchet-like serration on the container neck and an internal serration on the safety band may prevent the closure from being rotated.

17 Claims, 8 Drawing Figures

12
11
2
7
8
10
B 11
13

2
3
1
16
9
6
B 2
3
1
17
6
14
13
4
5
15
21
B

PLASTIC CLOSURE WITH SAFETY BAND

BACKGROUND OF THE INVENTION

1. Field of the Invention

The present invention relates to a plastic closure attachable directly or indirectly to a container neck and provided with adjustment means allowing it to adopt different positions relative to the container neck. The closure is maintained closed by a safety band in an upper safety position in which the closure is higher with respect to the upper edge of the container neck, whereas a lower position corresponds to the access position of the closure.

2. Description of the Prior Art

Many prior art closures are known which have lower edges provided with safety bands and which are positively retained on the container by means of ratchet-like serrations. In this way, the closure is prevented from becoming unscrewed when it is in the safety position. Reference is made in this context to German Patent Publications DE-A Nos. 24 56 931 and 29 04 181, as well as U.S. Pat. No. 3,986,634. All of these prior art documents teach rotary closures.

In recent years however, snap-on hinge type closures have become increasingly common because they are easier to handle. This type of closure, however, not only has to be secured against becoming unscrewed, but measures also have to be taken to prevent the cap from lifting off from the closure. The most obvious and simple way of dealing with this problem is to provide the closure with two safety bands, one to prevent it from becoming unscrewed, and a second to secure the cap on the closure. This type of arrangement, however, is undesirable because it is difficult to manufacture and handle, and it is difficult for the user to understand how it works.

Prior art teachings relating to two-stage closures of the type referred to above do not suggest how to provide a suitable sealable hinged closure.

SUMMARY OF THE INVENTION

An object of the present invention is to provide a design for a sealable closure which is suitable for hinged closures.

This objective is met by the closure of this invention comprising a base with a spout opening, and a sealing cap connected to the base by a hinge, whereby in its closed position the cap seals and covers the spout opening. The cap is provided with at least one locking means comprising a catch which is lockable in the base of the closure and which is releasable from the base to attain the access position of the closure either by direct contact with the upper edge of the container neck or by contact with the upper edge of an intermediate piece mounted on the container neck.

BRIEF DESCRIPTION OF THE DRAWINGS

The accompanying drawings illustrate two fundamental embodiments of the present invention, which will be elucidated in the following detailed description. In the drawings.

Figure 3:
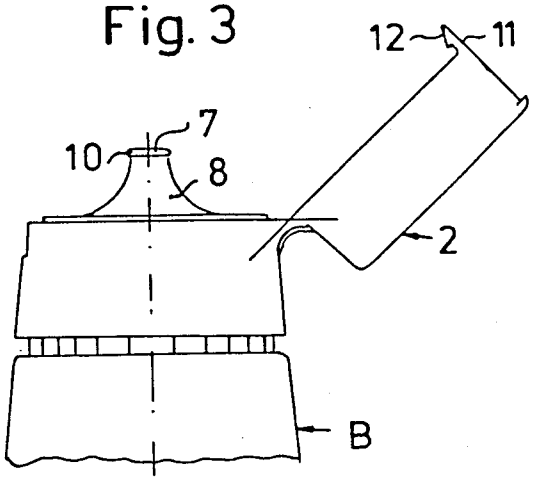
FIG. 3 is a side view of the same closure of FIG. 2 in an open position.
Figure 3A:
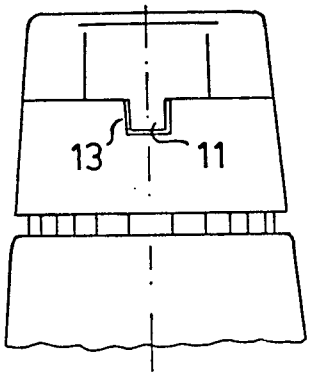
Figure 6:
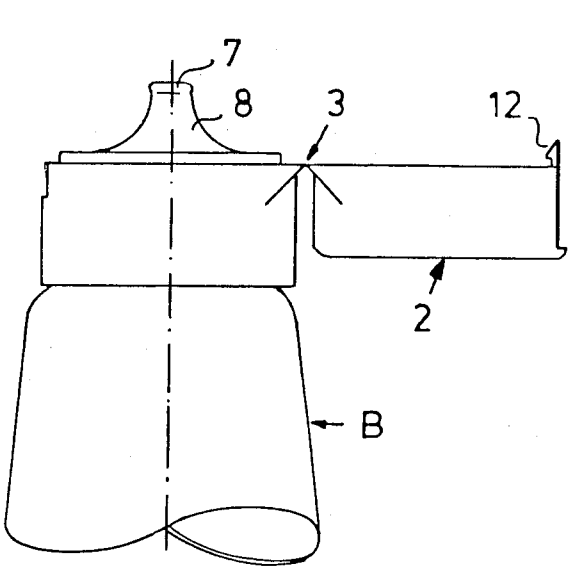
Figure 5:
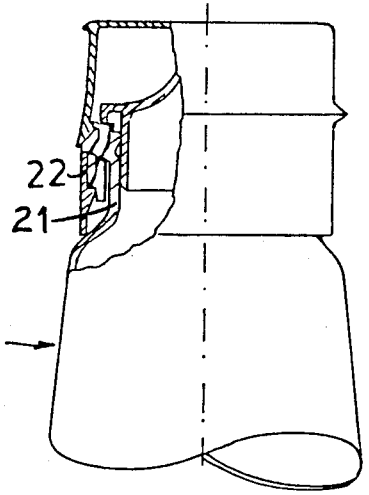
Figure 4:
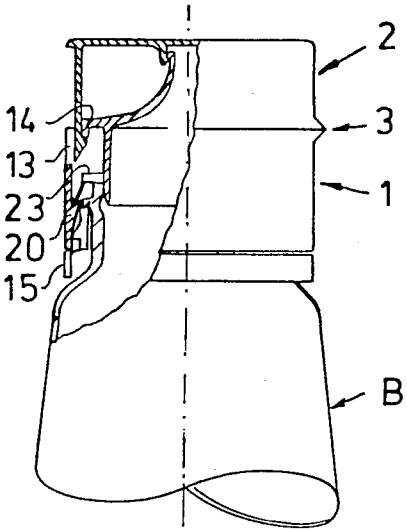

FIG. *3a* is a front view of the same closure of FIG. 3 in a closed position;

FIG. 4 is a partial lateral cross-sectional view of another embodiment of a closure in the secured position;

FIG. 5 is a partially cross-sectional view of the closure of FIG. 4 in its access position;

FIG. 6 is a side view of the closure of FIG. 5 in an open position; and

Figure 7:
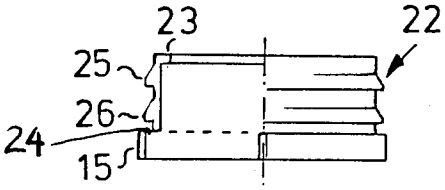

FIG. 7 is a partial lateral corss-sectional view of an intermediate piece.

DESCRIPTION OF PREFERRED EMBODIMENTS

The plastic hinged closure comprises base 1, cap 2 and hinge 3 of the usual type. Base 1 of the closure is provided with internal connection means by which it may be mounted on container B. In the embodiment shown in FIGS. 1–*3a*, inclusive, the connection means comprises internal thread 4 which matches external thread 5 provided on container B. Leak-proof annular seal 6 impinges on the inner side of the container neck and prevents the contents of the container from escaping from the container or leaking into the area between base 1 and cap 2. In this way, the container contents can escape from the container only through spout 8 terminating in spout opening 7 which extends above the upper edge of leak-proof annular seal 6.

Spout opening 7 is covered by cap 2 in the closed position of the closure. Cap 2 is provided with sealing means which may take the form of an extending plug, or alternatively may comprise annular sealing lip 9, as shown in the illustrated embodiment. When the cap is closed, this sealing lip encompasses the upper part of spout 8. The tightness of the seal is enchanced by providing bead 10 at spout opening 7.

The side of cap 2 opposite hinge 3 may be provided with tongue 11 with catch 12 at its terminal end. Tongue 11 and catch 12 together comprise a locking means which engages below projection 14 of base 1 of the closure, thus preventing cap 2 from opening when it is in the secured position shown in FIG. 1. Projection 14 extends radially beyond leak-proof annular seal 6.

Figure 2:
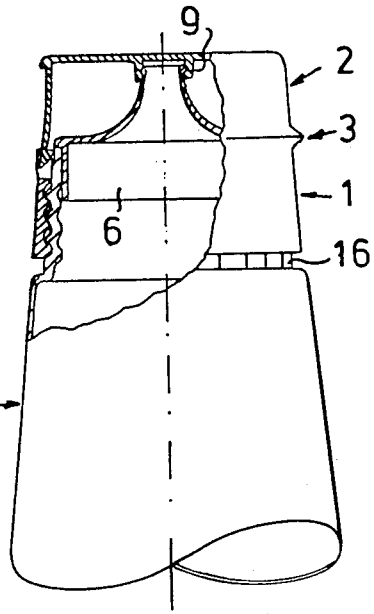
FIG. 2 is a partially cross-sectional view of the closure of FIG. 1 in its access position.

One-piece safety band 15 is connected to the closure by means of a plurality of ribs or by a continuous seam, and is formed together with the lower edge of base 1. This safety band encompasses the container neck and is provided with a tear tag facilitating removal of safety band 15. On its inner side facing the container neck, the safety band may be contoured, such as provided with toothed serrations, for example, of the type taught in the prior art referred to above. The serrated contour of the safety band is not visible in the drawings, whereas contoured profile 16 of the container neck which engages with the aforesaid contoured profile of the safety band is shown in FIGS. 2 and 3.

The closure, which may be molded and produced as an open component, is placed on the full container in a closed position and screwed until the lower edge of safety band 15 bears on the container. At this point the closure is in the secured position. Since the serrated contour of safety band 15 is engaged in the matching serrated contour of the container neck, the closure cannot be unscrewed. Locking means 11, 12 on cap 2 engages below projection 14 of base 1 and as a result the cap cannot be opened.

If the safety band is now removed, the closure can be screwed downward until reaches its lower access position. At this point, the oblique contact surface of catch 12 bears on the upper edge of the container neck and is consequently forced outward from projection 14 (FIG. 2). The closure has now attained its access position and the cap can be easily rotated about the axis of hinge 3, as is conventional with commercially available types of hinged closures. This arrangement is also suitable for use with a snap-on rather than screw-on type of hinged closure.

FIGS. 4–6 shows a similar type of hinged closure provided on container B. The manufacturer of the closure will, in many cases, not have any influence with respect to the shape of the container neck. In order to take full advantage of the type of closure described here, which provides a safety position as well as an access position, an intermediate piece may be mounted on the container, with the aid of which this type of closure may be adapted to container necks of any shape.

Unlike the embodiment described above, the contour of this closure is cylindrical rather than conical; however, other shapes may be used as well. In this embodiment, the configuration of cap 2, hinge 3, spout 8 with spout opening 7 and locking means 11, 12 is similar to that of their counterparts in the first embodiment described above. The base is different, however, and in this embodiment is provided with several tabs or a continuous projecting ring 20 having a hook-shaped cross section instead of an internal thread. The ring or tabs are manufactured in one piece with the base of the closure and serve as locking devices.

Figure 1:
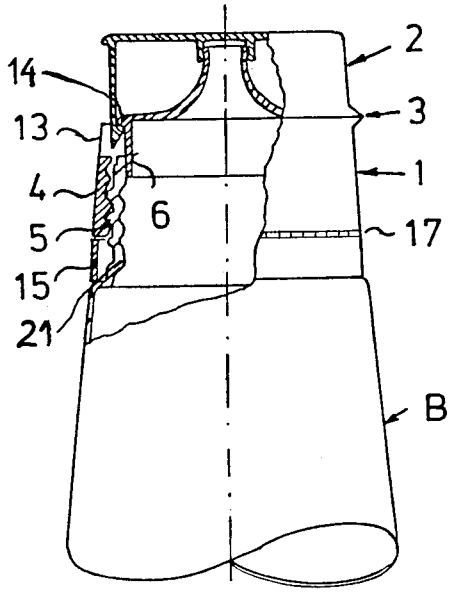
FIG. 1 is a partial lateral cross-sectional view of a one-piece hinged closure in its secured position.

Intermediate piece 22 may be mounted on container neck 21 to function as an integral part of the container neck. Safety band 15 may be provided at the lower end of the intermediate piece. The intermediate piece may be configured as a cylindrical ring with shoulder 23 projecting radially inwards and bearing on the edge of container neck 21. Safety band 15 provided at the lower edge of intermediate part 22 can be connected to base 1 by means of 17, or alternatively over a continuous seam 24. Ribs 17, as shown in FIG. 1, or continuous seam 24, as shown in FIG. 7, are not arranged in an axial pattern but are disposed facing radially outwardly so that safety band 15 is provided flush with and underneath the outer wall of base 1 of the closure.

Intermediate piece 22 is provided with first upper locking projection 25 and second lower locking projection 26 which take the form of two annular projections. The cross section of these two annular projections is identical and takes the form of a right-angled triangle. Oppositely to projecting ring 20 provided on base 1 of the closure, the horizontal surfaces of these annular projections, which are arranged projecting radially outwards, face downward.

A closure in the closed position is pressed onto the container neck provided with intermediate piece 22 until projecting ring 20 of base 1 snaps over the first locking annular projection 25 of intermediate piece 22. While the closure is still in the secured position, it cannot be removed from container B or from intermediate piece 22, because the two horizontal surfaces of the projecting ring and the upper annular projection of the intermediate piece are bearing on one another. Cap 2 cannot be opened in the way described in the first embodiment, because catch 12 is locked below projection 14 of the base of the closure through aperture 13. Nor can the closure be displaced axially downwards because it bears on safety band 15, which is connected with the intermediate piece fastened to the container.

When the safety band has been torn off, the closure can be displaced axially by downward pressure exerted on the cap. At this point, projecting ring 20 and its horizontal bearing surface will slide over the oblique surface of second annular projection 26 which provides a second lower locking projection. Projecting ring 20 engages underneath second annular projection 26 and comes to bear on the intermediate piece of the closure. At the same time, the upper edge of the intermediate piece automatically releases catch 12 from behind projection 14, so that nothing now prevents cap 2 from being opened.

A closure of this type, which requires only axial displacement to move from its safety to its access position, can be additionally secured utilizing grooves and tongues or cams which engage in the grooves to provide an extra means of preventing the closure from rotating, if such an arrangement is required to insure maintaining the closure at a specific position.

The first embodiment of the closure according to the present invention may be provided with a projecting ring as well, if the container neck is provided with first and second locking projections according to the prescribed arrangement of the intermediate piece.

Instead of a safety band, an equivalent means of securing the closure may be employed which takes the form of a plurality of partial elements which are simply pressed outwards from their safety position instead of being torn off.

I claim:

1. A container closure made of plastic material attachable to a container neck, said closure provided with means for adjusting it between an upper safety position and a lower access position relative to said container neck, said closure maintained in said safety position by means of a removable safety band (15), said closure comprising a base (1) with a spout opening (7), a sealing cap (2) connected to said base by a hinge (3), said closure adjustable between an open position wherein said spout opening is uncovered, and a closed position wherein said cap seals and covers said spout opening; said cap provided with at least one locking means (11, 12) which, when the closure is in said safety position, engages underneath a projection (14) in an aperture (13) in said base (1) of the closure, and when said closure is in said access position, said locking means is released from engagement with said projection by contact with an upper edge of said container neck.

2. A closure according to claim 1 attached to a container neck, wherein an external thread (5) is provided on said container neck and an internal thread (4) is provided on said base (1) of said closure to provide adjustment of said closure from said safety position to said access position by screwing, and said safety band (15) and said container neck are provided with serrations, said serrations on said safety band (15) engageable with matching said serrations on said container neck to prevent said closure from becoming unscrewed while it is in said safety position.

3. A closure according to claim 1 attached to a container neck, wherein a first annular projection (25) and a second annular projection (26) are provided on said container neck (B) and a projecting ring (20) is provided on the inner side of said base, whereby said closure is maintainable in said safety position by interaction between said first annular projection and said projecting ring, and said closure is adjustable to said access position by axial adjustment of said closure to provide interaction of said second annular projection with said projecting ring.

4. A closure according to claim 1, wherein said closure has a substantially cylindrical external contour and said locking means (11, 12) is provided on said cap (2) diagonally opposite said hinge (3).

5. A closure according to claim 1, wherein said locking means comprises a catch (12).

6. A closure according to claim 1, wherein said safety band (15) is provided on said base (1) of said closure.

7. A closure according to claim 1 attached to a container neck, wherein said spout opening (7) is provided with a leak proof annular seal (6) impinging on an inner surface of said container neck.

8. A closure according to claim 1 attached to a container neck.

9. A closure according to claim 1, wherein said sealing cap (2) is provided on its inner surface with an annular sealing lip (9) aligned with and sealing said spout opening (7) when said closure is in said closed position.

10. A closure according to claim 9, wherein said spout opening (7) is provided with a bead (10) which seals with said annular sealing lip (9) when said closure is in said closed position.

11. A container closure made of plastic material attachable to a container neck, said closure provided with means for adjusting it between an upper safety position and a lower access position relative to said container neck, said closure maintained in said safety position by means of a removable safety band (15), said closure comprising a base (1) with a spout opening (7), a sealing cap (2) connected to said base by a hinge (3), and an intermediate piece (22) mountable between the inner surface of said base (1) and the outer surface of said container neck, said closure adjustable between an open position wherein said spout opening is uncovered, and a closed position wherein said cap seals and covers said spout opening; said cap provided with at least one locking means (11, 12) which, when the closure is in said safety position, engages underneath a projection (14) in an aperture (13) in said base (1) of the closure, and when said closure is in said access position, said locking means is released from engagement with said projection by contact with an upper edge of said intermediate piece (22).

12. A closure according to claim 11 attached to a container neck, wherein an external thread is provided on said intermediate piece (22) and an internal thread (4) is provided on said base (1) of said closure to provide adjustment of said closure from said safety position to said access position by screwing.

13. A closure according to claim 12 attached to a container neck wherein said intermediate piece (22) has a continuous ring projecting inwardly which bears on the upper edge of said container neck.

14. A closure according to claim 12, wherein said safety band (15) is provided on said intermediate piece (22) and is arranged below and flush with said base (1) of said closure.

15. A closure according to claim 11 attached to a container neck wherein a first annular projection (25) and a second annular projection (26) are provided on said intermediate piece (22) mounted on said container neck, and a projecting ring (20) is provided on the inner side of said base (1), whereby said closure is maintainable in said safety position by interaction between said first annular projection and said projecting ring, and said closure is adjustable to said access position by axial adjustment of said closure to provide interaction of said second annular projection with said projecting ring.

16. A closure according to claim 14, wherein said safety band (15) is provided on said intermediate piece (22) and is arranged below and flush with said base (1) of said closure.

17. A closure according to claim 11 attached to a container neck.

* * * * *